US008814597B2

(12) United States Patent
Jacob et al.

(10) Patent No.: US 8,814,597 B2
(45) Date of Patent: Aug. 26, 2014

(54) ELECTRICAL PLUG CONTACT

(75) Inventors: Anna Jacob, Öhringen (DE); Michael Knödler, Stuttgart (DE)

(73) Assignee: Amphenol-Tuchel Electronics GmbH, Heillbronn (DE)

( * ) Notice: Subject to any disclaimer, the term of this patent is extended or adjusted under 35 U.S.C. 154(b) by 0 days.

(21) Appl. No.: 13/503,758

(22) PCT Filed: Sep. 11, 2010

(86) PCT No.: PCT/EP2010/005583
§ 371 (c)(1),
(2), (4) Date: Jul. 27, 2012

(87) PCT Pub. No.: WO2011/069568
PCT Pub. Date: Jun. 16, 2011

(65) Prior Publication Data

US 2012/0282795 A1 Nov. 8, 2012

(30) Foreign Application Priority Data

Dec. 7, 2009 (DE) ..... 10 2009 056 972

(51) Int. Cl.
*H01R 9/03* (2006.01)
*H01R 9/05* (2006.01)
*H01R 13/648* (2006.01)

(52) U.S. Cl.
CPC ..... *H01R 9/0527* (2013.01); *H01R 13/648* (2013.01)
USPC ..... 439/607.41; 439/607.54

(58) Field of Classification Search
USPC ..... 439/607.41, 607.54
See application file for complete search history.

(56) References Cited

U.S. PATENT DOCUMENTS

| | | | | |
|---|---|---|---|---|
| 5,498,176 | A | 3/1996 | Hashizawa et al. | |
| 5,658,170 | A * | 8/1997 | Tan et al. | 439/607.41 |
| 5,803,767 | A | 9/1998 | Matsumoto et al. | |
| 5,938,475 | A * | 8/1999 | Penner et al. | 439/607.44 |
| 6,053,749 | A | 4/2000 | Masuda et al. | |
| 6,331,123 | B1 | 12/2001 | Rodrigues | |
| 7,021,967 | B2 * | 4/2006 | Mullin | 439/607.41 |
| 7,048,578 | B2 * | 5/2006 | Rodrigues | 439/578 |
| 7,427,215 | B2 * | 9/2008 | Heckmann et al. | 439/607.41 |
| 7,892,026 | B2 * | 2/2011 | Langhoff et al. | 439/607.02 |
| 8,011,969 | B2 * | 9/2011 | Wang et al. | 439/660 |
| 2003/0003805 | A1 * | 1/2003 | Yamamoto | 439/610 |

(Continued)

FOREIGN PATENT DOCUMENTS

| | | |
|---|---|---|
| CN | 1354537 A | 6/2002 |
| CN | 1479417 A | 3/2004 |

(Continued)

*Primary Examiner* — James Harvey
(74) *Attorney, Agent, or Firm* — Blank Rome LLP

(57) ABSTRACT

The present invention relates to an electrical plug contact, comprising—a line having an insulating section, a fastening section, and a contacting section,—a line shield that at least partially encloses the line,—a connector that electrically contacts the line at the end of the line in the contacting section,—an insulating retainer, which locks with the connector and which is arranged in the contacting and fastening sections, for insulating the connector from an electrically conductive housing, and—a secondary locking sleeve that at least partially surrounds the line in the fastening section and that can be fastened to the line, wherein shielding transfer means are provided in order to transfer the shielding from the line shield to the housing.

9 Claims, 5 Drawing Sheets

(56) References Cited

U.S. PATENT DOCUMENTS

| | | | | |
|---|---|---|---|---|
| 2006/0121783 | A1* | 6/2006 | Wu et al. | 439/607 |
| 2008/0113559 | A1* | 5/2008 | Hamai et al. | 439/610 |
| 2009/0093170 | A1 | 4/2009 | Shinkawa et al. | |
| 2009/0111323 | A1* | 4/2009 | Burris et al. | 439/578 |
| 2012/0282795 | A1* | 11/2012 | Jacob et al. | 439/346 |

FOREIGN PATENT DOCUMENTS

| | | | |
|---|---|---|---|
| DE | 3640478 | A1 | 6/1988 |
| DE | 3730432 | C1 | 10/1988 |
| DE | 3734667 | C1 | 3/1989 |
| DE | 3732520 | A1 | 4/1989 |
| DE | 9108708 | U1 | 10/1991 |
| DE | 19727453 | A1 | 1/1999 |
| DE | 19829291 | A1 | 2/1999 |
| DE | 19909415 | A1 | 3/2000 |
| DE | 19901734 | A1 | 7/2000 |
| DE | 10146595 | A1 | 2/2003 |
| DE | 102008004801 | A1 | 8/2008 |
| DE | 102007037177 | A1 | 2/2009 |
| EP | 1965467 | A1 | 9/2008 |
| GB | 2312341 | A | 10/1997 |

* cited by examiner

ELECTRICAL PLUG CONTACT

REFERENCE TO RELATED APPLICATION

This patent application is a national stage of PCT/EP2010/005583, filed Sep. 11, 2010, which claims priority to German patent application No. 10 2009 056 972,3 filed on Dec. 7, 2009, the entire disclosures of which are incorporated herein by reference.

BACKGROUND OF THE INVENTION

This invention relates to an electrical plug contact and a system incorporating the electrical plug contact.

These plug contacts are used for example in motor vehicles. The efforts of the automotive sector amount to using components for as many series as possible with different requirements so that modular concepts are often the goal. At the same time, there is the stipulation of implementing as small a diversity of parts as possible with as few different materials as possible. On the other hand, mounting should be as simple as possible and at the same time as reliable as possible so that errors are avoided in installation.

BRIEF SUMMARY OF THE INVENTION

In generic electrical plug contacts there is moreover the demand for their suitability for installation in the engine compartment; this especially entails requirements with respect to tightness, optimization of installation space and integration as well as ease of preparation.

Moreover there is the technical problem that there must be considerable line cross sections due to the high currents.

Another technical problem is the vibrations and impacts which occur in the operation of motor vehicles.

Therefore the object of the invention is to provide an electrical plug contact which, while avoiding the aforementioned technical problems, at the same time offers advantages with respect to quality and/or costs.

This object is achieved with the electrical plug contact and system of the invention. Advantageous developments of the invention are given herein. All combinations of at least two of the features given in the specification, the claims and/or the figures also fall within the framework of the invention. At the given value ranges, values within the indicated limits will also be considered to be disclosed as boundary values and will be claimed in any combination.

The idea of the invention is to configure an electrical plug contact, especially in a housing with other preferably identical electrical plug contacts, with a capacity to be prefabricated, by a detachable linkage of electrical or electronic devices which are required for the operation of a motor vehicle with electrical or electrically supported drive being enabled. The electrical plug contact thus follows a modular concept by several, preferably identical or corresponding electrical plug contacts in one housing having the capacity to be prefabricated, there being a continuous shield linkage. The electrical plug contact is made as a straight plug contact.

In one advantageous embodiment of the invention it is provided that the especially elastically made shielding transfer means, especially peripherally closed, preferably made as a spring rim, is located in the fastening section. The shielding transfer can take place in a simple, space-saving manner, especially by a single, separate component by the arrangement of the shielding transfer means in the fastening section.

Advantageously the shielding transfer means are pointed opposite one plug-in direction S in another embodiment of the invention with one free spring end, especially overlapping the line shield. In this way the shielding action is so to speak at least doubled and it is thus ensured that optimum shielding take place on the problematic shielding transfer.

By the conductor and/or the line shield and/or the shielding transfer means and/or the insulating sleeve and/or the secondary locking sleeve being arranged in the plug-in direction S and/or axially flush, the electrical plug contact can be easily and reliably mounted and at the same time can be prefabricated.

Furthermore, in this invention there is advantageously a seal which adjoins especially the periphery of the line jacket, forming a seal, for sealing of the fastening and/or contact-making section relative to the insulating section. For better sealing, the seal advantageously has at least two annular beads in order to ensure optimum sealing.

According to another advantageous embodiment, on one end face of the insulating retainer pointing in the plug-in direction S there are alignment detection means for recognizing the alignment of the electrical plug contact in one direction. R of rotation relative to the housing. This embodiment is used especially when there are several electrical plug contacts next to one another for purposes of differentiation and accordingly correct mounting of the electrical plug contacts with the pertinent mating connector.

To the extent there is at least one rib for alignment of the electrical plug contact relative to at least one corresponding groove of the housing on the periphery of the insulating retainer, the housing can be coded accordingly in order to prevent twisting of the electrical plug contact in the direction R of rotation. By the groove in the direction R of rotation being located distributed on the periphery or at least in another position in the housing or in the chambers assigned to each electrical plug contact, in spite of identical configuration of the electrical plug contact or of the electrical plug contacts there can be a differentiation of the electrical plug contacts based on their position, especially recognizable by the alignment detection means.

The invention moreover relates to a system of a housing with at least one, preferably two, even more preferably at least three, ideally exactly three, chambers and above described electrical plug contact(s) which can be accommodated in the chamber/chambers of the housing.

In one advantageous embodiment of the system the grooves corresponding to the ribs of the electrical plug contacts are located in the peripheral direction of the chambers at different positions.

Other advantages, features and details of the invention will become apparent from the following description of preferred exemplary embodiments and using the drawings.

DETAILED DESCRIPTION OF THE INVENTION

In the figures the same components and components with the same function are labeled with the same reference numbers.

Figure 1:
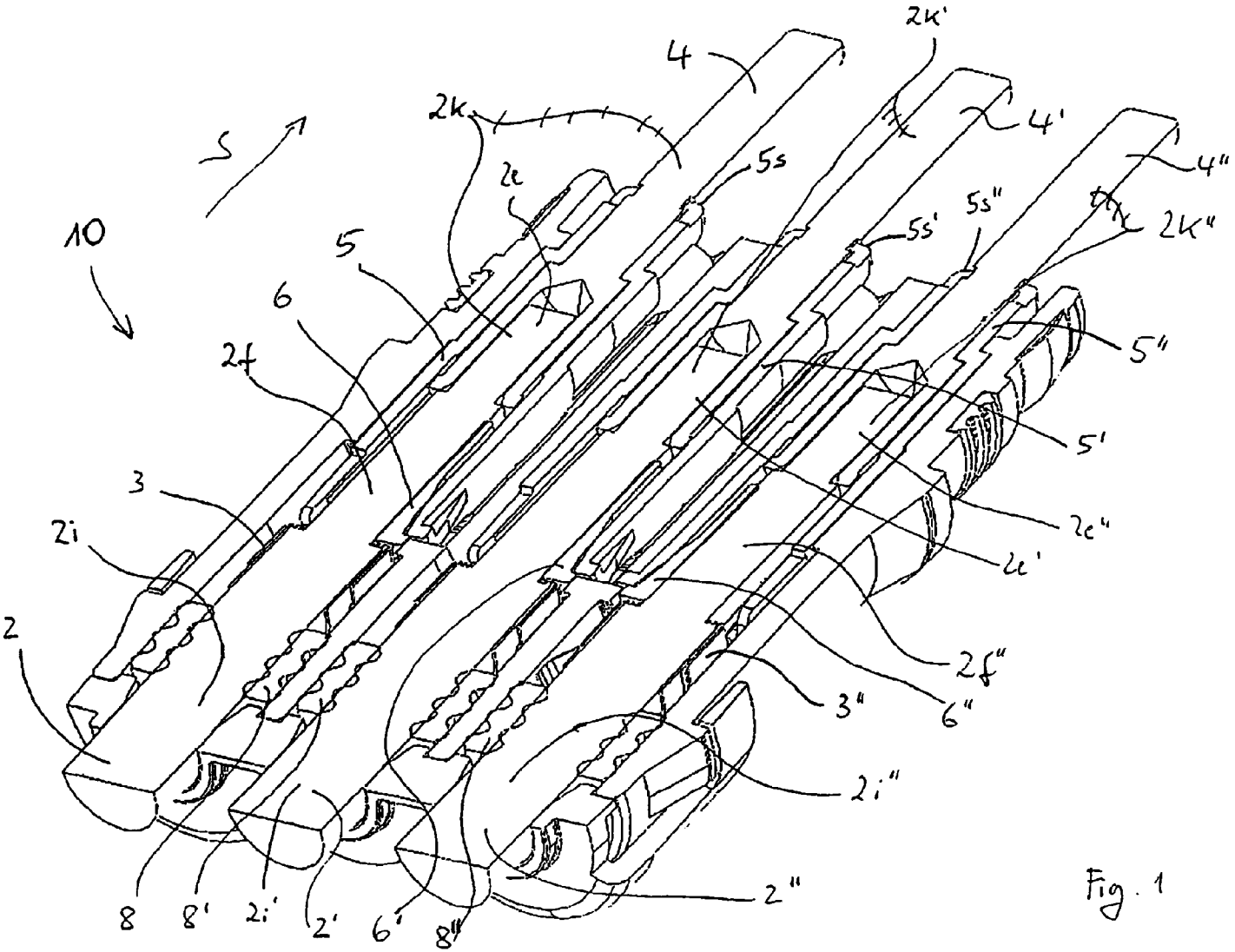
FIG. 1 shows a cutaway perspective of a system as claimed in the invention consisting of a housing and three electrical plug contacts as claimed in the invention.

In FIG. 1 the three electrical plug contacts 1, 1', 1" are held in one the electrical plug contacts 1, 1', 1" in chambers 13, 13', 13" of a housing 10 (see FIG. 2) [sic]. Lines 2, 2', 2" of the electrical plug contacts 1, 1', 1" are designed for high current intensities between roughly 60 A and roughly 150 A. The lines 2, 2', 2" are at the same time the core element of the electrical plug contact. The lines 2, 2', 2" from one line set which is not shown end in the electrical plug contact 2, 2', 2", where they are each electrically connected conductively to one assigned connector 4, 4', 4". In this case, by accommodation of the line ends 2*e*, 2*e'*, 2*e"* into corresponding blind holes 4*s*, 4*s'*, 4*s"* of the connectors 4, 4', 4" [sic].

The electrical plug contacts 1, 1', 1" are each divided into an insulating section 2*e*, 2*e'*, 2*e"*, a fastening section 2*f*, 2*f*, 2*f'* and a contact-making section 2*k*, 2*k'*, 2*k"* which can partially overlap. The fastening section 2*f*, 2*f*, 2*f'* is located between the insulation section 2*e*, 2*e'*, 2*e"* and the contact-making section 2*k*, 2*k'*, 2*k"*, viewed in one plug-in direction S. The respective line 2, 2', 2" is insulated in the insulating section 2*e*, 2*e'*, 2*e"*.

The line 2, 2', 2" is a coaxial cable with an outer jacket insulation, a line shield 3, 3', 3" which is made as a braided screen and which is located radially inside the outer jacket insulation, intermediate insulation which is located radially within the line shield 3, 3', 3", and the central core which carries current in operation.

Figure 3A:
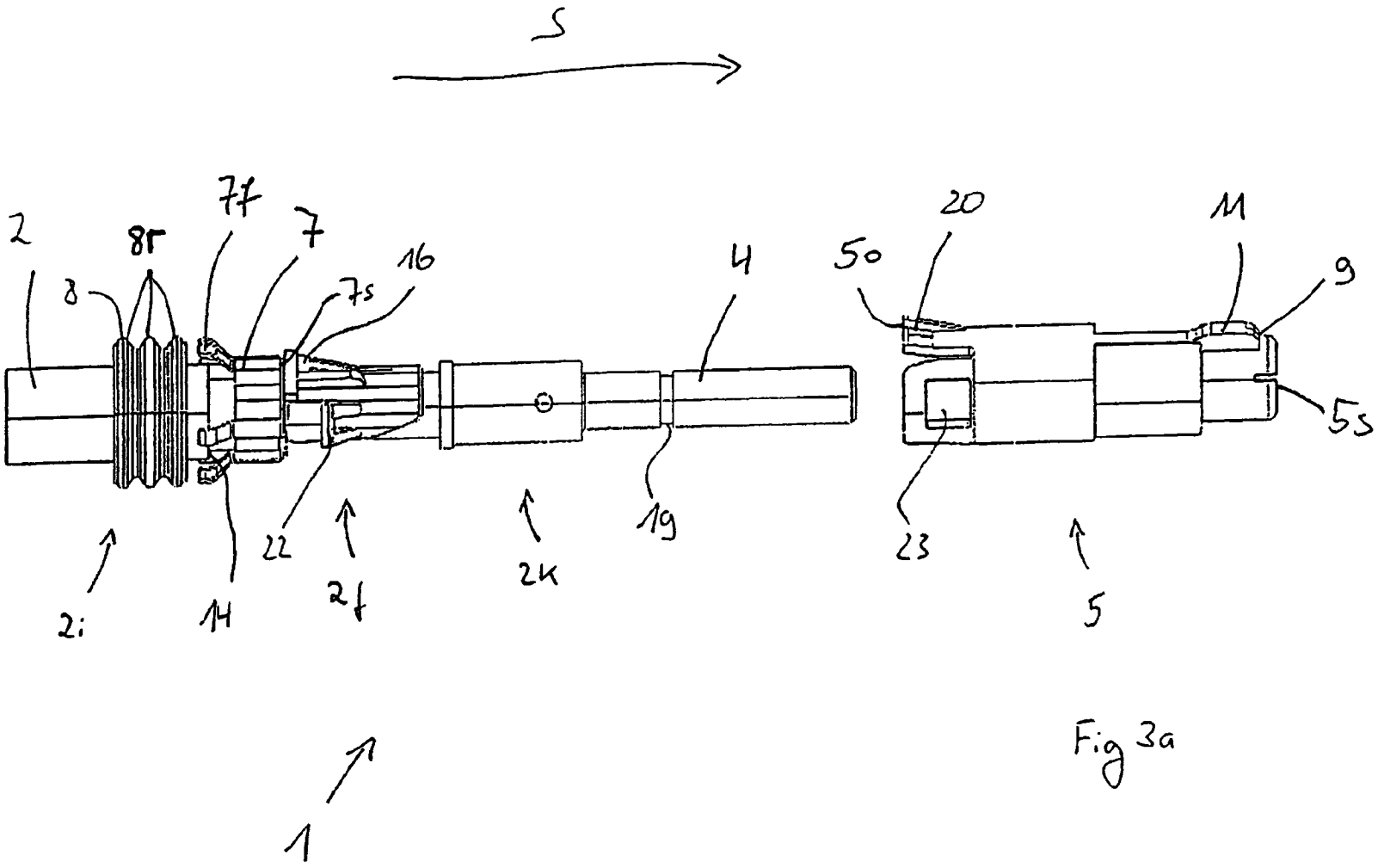
FIG. 3*a* shows a side view of an electrical plug contact as claimed in the invention with an insulating retainer in the unplugged state.
Figure 3B:
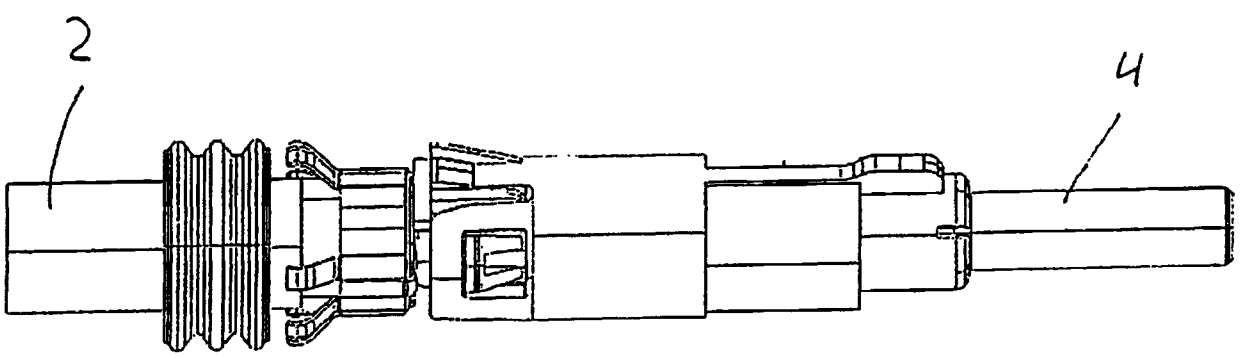
FIG. 3*b* shows a side view of the electrical plug contact with an inserted insulating retainer.

The insulation of the electrical plug contact 1 which is shown in FIGS. 3*a* and 3*b* is stripped in the fastening section 2*f*, as a result of which at the transition between the fastening section 2*f* and the insulating section 2*e* a peripheral shoulder 14 is formed. In the fastening section thus from the line 2 there are only in addition the central core and the intermediate insulation, the braided shield without the external jacket insulation or the cable jacket extending from the shoulder 14 over one partial region of the fastening section 2*f* in order to undertake shielding transfer in this region.

The braided screen makes contact with the free spring ends 7*f* by an electrically conductive spring rim 7, the free spring ends 7*f* projecting over the peripheral shoulder 14 against the plug-in direction S.

The spring rim 7 with its end face 7*s* which lies in the plug-in direction S adjoins a secondary locking sleeve 6 which is clipped onto the stripped line 2 in the fastening section 2*f*. The secondary locking sleeve 6 is crimped on the line 2 by a metal sleeve 15 so that the secondary locking sleeve 6 does not slip axially and sits tightly on the line 2.

The metal sleeve 15 can be used at the same time as a contact mediator between the braided screen of the line 2 and the spring rim 7. The secondary locking sleeve 6 lies with an offset 16 on the top 5*o* on the insulating retainer 5, as a result of which the movement of the line 2 in the plug-in direction S is limited (see FIG. 4).

The insulating retainer 5 in turn is bordered in the plug-in direction S by a peripheral shoulder 5*u* which comes into contact with a stop 17 of the housing 10.

The position of the connector 4 is fixed with a locking capacity by locking a ring section 18 which is located on the end face 5*s* and which is pointed radially to the inside into a corresponding ring groove 19 of the connector 4 by the ring section 18 being interrupted on the periphery and thus being made elastic.

Figure 2:
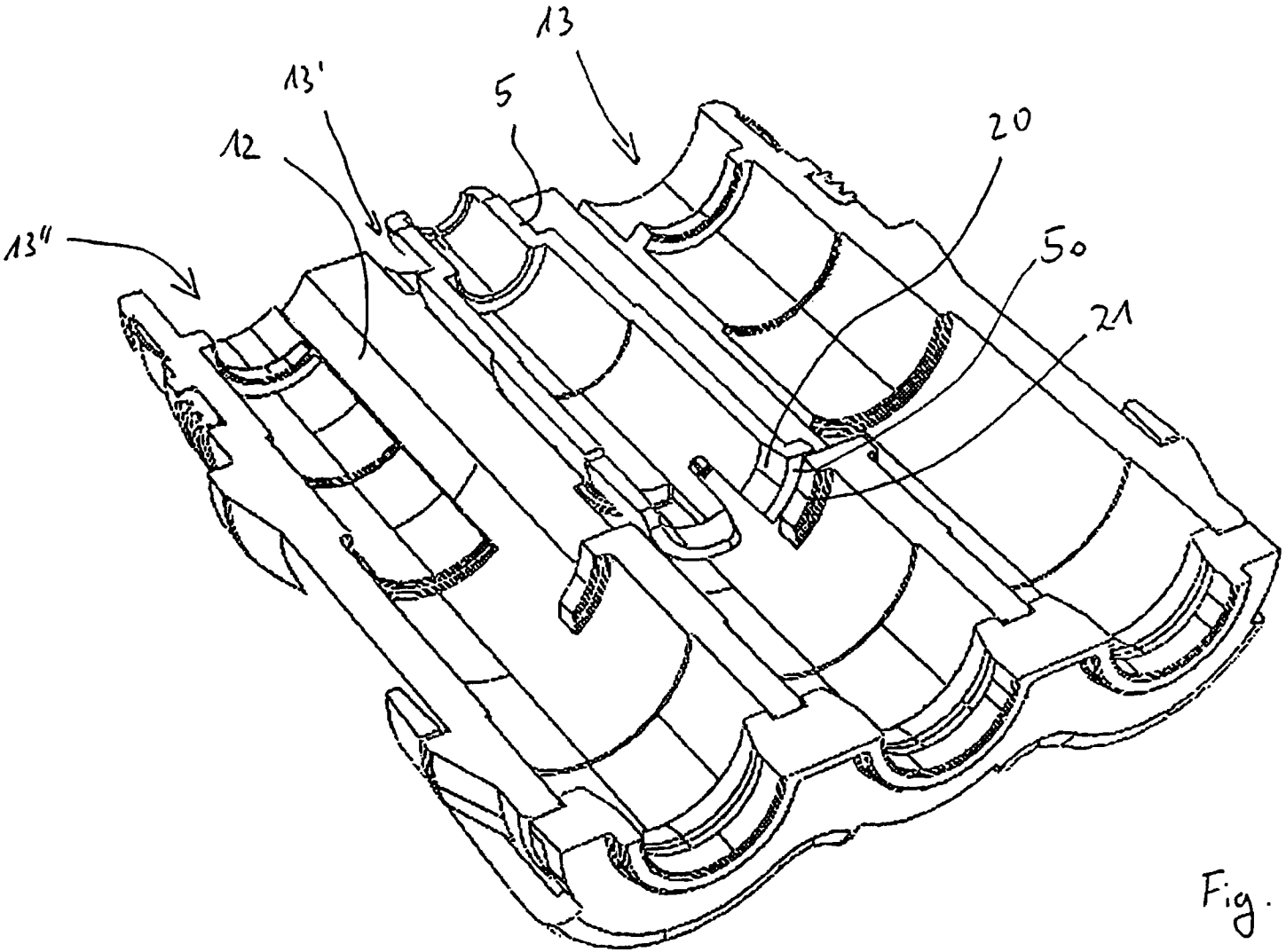
FIG. 2 shows a cutaway perspective of a housing with an insulating retainer.
Figure 4:
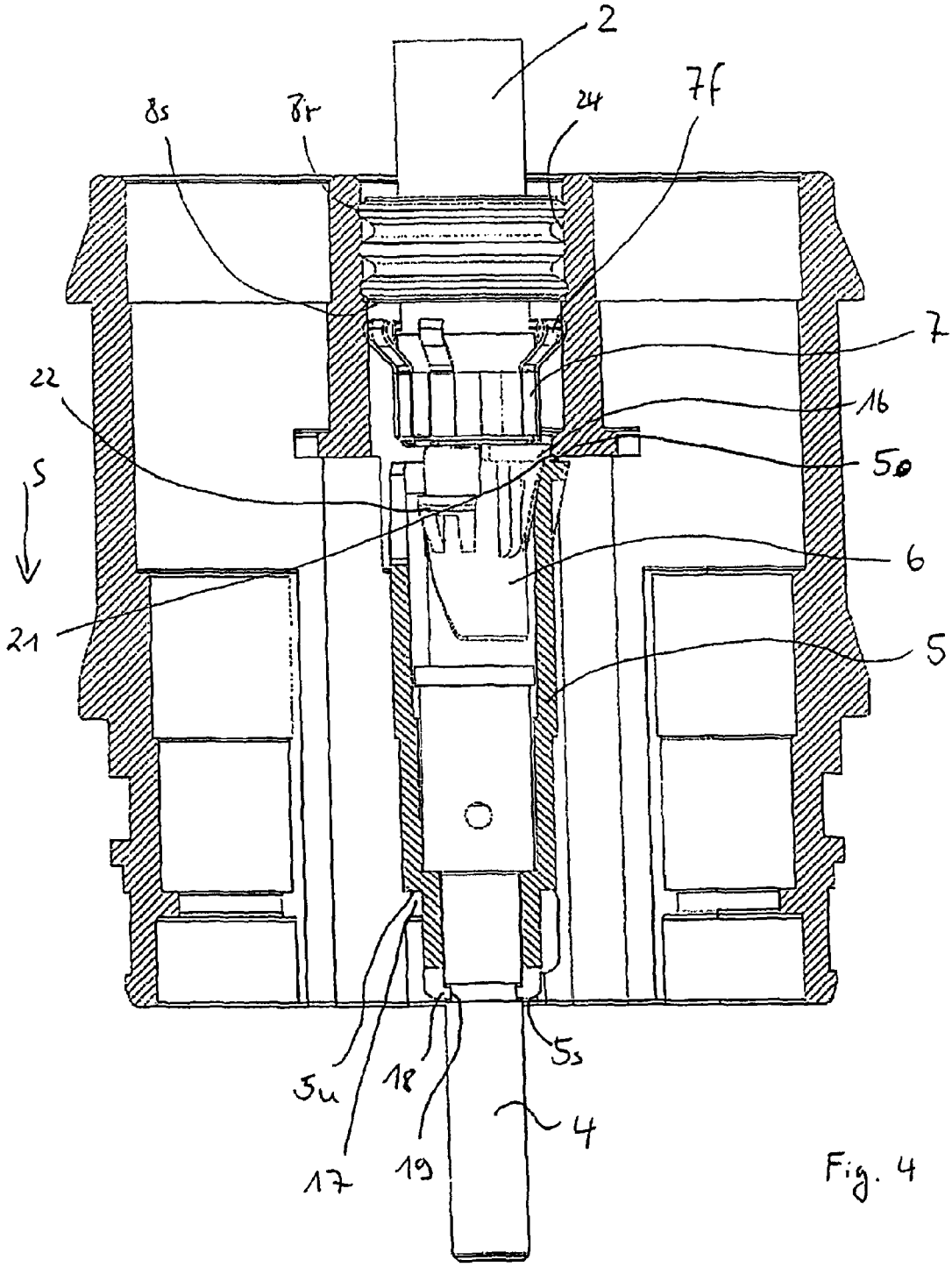
FIG. 4 shows a cutaway plan view of the housing with an inserted electrical plug contact.

The insulating retainer 5 with its top 5*o* at the same time limits the motion of the insulating retainer 5 opposite the plug-in direction S by the top 5*o* with a spring section 20 whose free spring end lies on the top 5*o* the movement opposite the plug-in direction S being limited [sic] by the spring arm 20 locking into the chamber 13 of the housing when the insulating retainer 5 is inserted, on a correspondingly configured shoulder 21 (see FIG. 2 and FIG. 4).

The spring arm 20 after inserting the line 2 according to FIGS. 3*a* and 3*b* is locked by the secondary locking sleeve 6, especially its offset 16, so that the insulating retainer 5 is prevented from being pulled out by the secondary locking sleeve 6 with the line 2 plugged in.

At the same time, the secondary locking sleeve 6 with a catch projection 22 locks into a corresponding recess 23 of the insulating retainer 5 so that it is no longer possible to pull out the secondary locking sleeve 6 and thus pull out the line 2.

Above the spring rim 7 a seal 8 is slipped onto the outer jacket insulation of the line 2, forming a seal, and the seal 8 adjoins the inside wall 24 of the chamber with three peripheral ribs 8*r*, forming a seal.

As is shown in FIG. 1, the system shown there consisting of a housing 10 and three electrical plug contacts 1, 1', 1" can be premounted and in the mounted state it can be easily recognized from the outside from the end face 5*s* which plug contact corresponds to which mating connector since the orientation of the respective rib 11 can be recognized. The rib 11 can be used at the same time as a coding rib 11 for the mating connector.

Due to the configuration of the shielding transfer means as claimed in the invention, especially of the spring rim 7, the inner core of the line 2 is completely shielded, since the shielding is transferred offset to the rear on the entire periphery of the line and especially against the plug-in direction S so that direct shielding transfer takes place from the line shield 3 via the spring rim 7 and the inside wall 4 of the chamber which is made metallic or metal-coated. In order to perfect the shielding still further, in one advantageous version the end face 8*s* of the seal 8 pointed in the plug-in direction S is metal-coated.

REFERENCE NUMBER LIST

1, 1', 1" electrical plug contact
2, 2', 2" line
2*e*, 2*e'*, 2*e"* line ends
2*i* insulating section
2*f* fastening section
2*k* contact-making section
3 line shield
4, 4', 4" connector
4*s*, 4*s'*, 4*s"* blind holes
5 insulating retainer
5*s* end face
5*o* top
6 secondary locking sleeve
7 shielding transfer means, spring rim
7*f* free spring end
7*s* end face
8 seal
8*r* peripheral rib
8*s* end face
9 alignment detection means
10 housing
11 rib
12 groove
13, 13', 13" chambers
14 peripheral shoulder
15 metal sleeve

16 offset
17 stop
18 ring section
19 ring groove
20 spring arm
21 shoulder
22 catch projection
23 recess
24 inside wall of chamber

The invention claimed is:

1. An electrical plug contact with a line with an insulating section, a fastening section and a contact-making section, a line shield which at least partially surrounds the line, a connector which makes electrical contact with the line on the end of the line in the contact-making section, an insulating retainer which is located in the contact-making and fastening section and which locks with the connector and the line for insulating and fixing the connector relative to an electrically conductive housing, a secondary locking sleeve which is fastened to the line and which at least partially surrounds the line in the fastening section for elimination of a movement of the line in a plug-in direction, there being shielding transfer means for transfer of the shielding from the line shield to the housing.

2. The electrical plug contact as claimed in claim 1, wherein the shielding transfer means comprises a spring rim and is located in the fastening section.

3. The electrical plug contact as claimed in claim 1, in which the shielding transfer means are pointed opposite the plug-in direction with one free spring end, especially overlapping the line shield.

4. The electrical plug contact as claimed in claim 1, wherein the line and/or the line shield and/or the shielding transfer means and/or the insulating retainer and/or the secondary locking sleeve are arranged flush in the plug-in direction.

5. The electrical plug contact as claimed in claim 1, further comprising a seal which adjoins the periphery of the line or the line jacket, forming a seal, for sealing of the fastening and/or contact-making section relative to the insulating section.

6. The electrical plug contact as claimed in claim 1, in which on one end face of the insulating retainer pointing in the plug-in direction there are alignment detection means for recognizing the alignment of the electrical plug contact in one direction R of rotation relative to the housing.

7. The electrical plug contact as claimed in claim in which there is at least one rib for alignment of the electrical plug contact relative to at least one corresponding groove of the housing on the periphery of the insulating retainer.

8. A system of a housing with at least one chamber and electrical plug contact which can be accommodated in the chamber of the housing as claimed in claim 1.

9. The system as claimed in claim 8, in which grooves corresponding to the ribs of the electrical plug contacts are located in the peripheral direction of the chambers at different positions.

* * * * *